US006460214B1

(12) United States Patent
Chang

(10) Patent No.: US 6,460,214 B1
(45) Date of Patent: Oct. 8, 2002

(54) VIBRATION RESISTIVE INSTANT RESPONDING ROADWAY OR BRIDGE EXPANSION JOINT AND CONSTRUCTION METHOD OF THE SAME

(76) Inventor: Ming-Huang Chang, No. 25, Tzu Chiang Rd. Chi Tu Dist., Keelung City (TW)

( * ) Notice: Subject to any disclaimer, the term of this patent is extended or adjusted under 35 U.S.C. 154(b) by 0 days.

(21) Appl. No.: 09/817,283

(22) Filed: Mar. 27, 2001

(51) Int. Cl.[7] ..... E01D 19/04

(52) U.S. Cl. ..... 14/73.1; 14/73.5; 404/57; 404/58; 52/393; 52/396.03

(58) Field of Search ..... 14/73.1, 73.5; 404/47, 56, 57, 58, 67; 52/393, 395, 396.03, 396.04, 396.08, 402

(56) References Cited

U.S. PATENT DOCUMENTS 3,750,359 A * 8/1973 Balzer et al. ..... 404/57
3,797,188 A * 3/1974 Mansfeld ..... 14/73.1
5,791,111 A * 8/1998 Beenders ..... 404/67
6,022,169 A * 2/2000 Kim et al. ..... 14/73.1
6,112,488 A * 9/2000 Olson et al. ..... 52/167.1
6,128,874 A * 10/2000 Olson et al. ..... 52/232

* cited by examiner

*Primary Examiner*—Gary S. Hartmann
(74) *Attorney, Agent, or Firm*—Rosenberg, Klein & Lee

(57) ABSTRACT

A vibration resistant expansion joint is provided. The expansion joint includes a sustaining pedestal (1) which is formed from two L-shaped members (111 and 112). A plurality of shim assemblies (12), each containing a bifurcated tooth-like shim (121), are pivotally joined to the sustaining pedestal (1). Additionally provided is a foundation (3) formed of two L-shaped side members, each side member having a slide surface (33, 34) formed along a bottom edge thereof. A stepped bench unit (2), formed of a pair of benches, is slidably mounted on foundation (3).

9 Claims, 8 Drawing Sheets

VIBRATION RESISTIVE INSTANT RESPONDING ROADWAY OR BRIDGE EXPANSION JOINT AND CONSTRUCTION METHOD OF THE SAME

BACKGROUND OF THE INVENTION

1. Field of the invention

The present invention relates to vibration resistive instant responding roadway or bridge expansion joints and a construction method of the same, in particular, to a roadway or bridge expansion joint in which by means of movability of an expansion shim assembly in a sustaining pedestal to withstand vibration of the roadway or bridge and instantly rescue the roadway or bridge from collapsing. Moreover, a H configured clearance gauge is provided for determining clearances of adjacent component parts in constructing the expansion joint.

2. Description of the Prior Art

In selecting a well-suited expansion joint, in addition to effectiveness, other factors such as durability, economy, maintainability, and water drainage must also be taken into account.

Conventional roadway or bridge expansion joint, like one which was patented by Pat. No. 414820 in Taiwan is essentially a pre-buried elastic expansion joint element, this element restores its elastic property functionable as an expansion joint after the concrete dries which has been squeezing the element from the moment of pouring on. However, it has unsolvable problems of no way to expel water contained therein, and this expansion joint is only applicable for a short span roadway or bridge.

Another expansion joint disclosed by U.S. Pat. No. 382376 in Taiwan is essentially a sliding plate joint having an intricated structure which is susceptible to being filled with rubbish and loosing its effectiveness, on the other hand, its intricated structure gives rise of a high construction cost and difficulty in repairing. Besides, and expansion joint made of metallic material is inevitably corrosive.

Another well known conventional technology in the field of vibration resistive instant responding expansion joint is represented by so called "Finger Plate Joint" which is in the form of two piece of serrated steel plates. The serrated teeth of the two steel plates are staggeringly crossing one another so as to avoid squeezing each other when been stressed, and a drain ditch equipped beneath the expansion joint for draining water on the roadway or bridge surface. With this structure, the expansion joint is strongly constructed with steel plates formed with mutually staggered serration teeth to alleviate bouncing vibration imparted by heavy traffic, and at the same time, expel the water trickling down from the bridge or roadway surface. On the contrary, it has been reported that this expansion joint has disadvantages of high production cost, expensive repairing cost, and difficult to install.

In all, those aforementioned well known techniques about expansion joint have a common shortcoming of in complete vibration resistive property that the allowable clearance of the joint is insufficient to absorb the large verticall vibration deformational stress which might be caused by a severe earthquake resulting in catastrophic ruination of bridge and roadway and further leads to lives and property losses of human being.

Besides, in conventional techniques, some are want of assembly tools, while some are in need for special and complicated extra tools for assembly, both expensive labor cost and precious time are involved.

In view of the foregoing situation, the inventor of the invention herein conducted intensive research based on many years of experience gained through professional engagement in the manufacturing and construction of related products, with continuous experimentation and improvement culminating in the development of the improved structure for vibration resistive instant responding roadway or bridge expansion joint and construction method of the same herein.

SUMMARY OF THE INVENTION

It is an object of the present invention to provide a vibration resistive expansion joint having horizontally displaceable and turnable expansion shims which are replaceable one by one for defected shims, while the configuration of the shims can be changed according to specific requirements, moreover a proper clearance between two adjacent shims is reserved so as to cope with possible asymmetrical displacement of roadway or bridge surface separated by an expansion joint.

It is another object of the present invention to provide a vibration resistive expansion joint having stepped bench unit whose thickness and tilted angle is well-fitted to the grade of the roadway or bridge.

It is still another object of the present invention to provide a vibration resistive expansion joint equipped with a water receptacle beneath the expansion joint for releasing the water twickled down from the roadway or bridge surface.

It is one more object of the present invention to provide method for constructing an expansion joint having aforementioned effects.

For achieving these and other objects, the expansion joint of the present invention comprises a sustaining pedestal which is further formed of two sustasiming U shaped members, the top edge of each member is formed into a hinge bracket with a hinge hole, several expansion shim assemblies each formed of a bifurcated tooth like shim hinged to both side sustaining members are indented one antoher with those hinged at opposite member. Eash expansion shim assembly includes an independent tongue piece hinged to the sustaining member and is interposed in a gap of the bifurcated expansion shim and indented each other with opposite one. A hinge pin is used to connect each sustaining member with each expansion shim assembly. A foundation formed of two L shaped side members having a slide surface at each bottom surface thereof is provided with several fins at both outer side surfaces, and a guide rail is formed along each outer edge of the slide surface. A stepped bench unit formed of a pair of benches disposed at different elevation is slidably mounted on both side surfaces of the side foundation members. A water receptacle made of watertight material and having flanges along both side edges is inlaid in the both guide rails of the foundation to collect the water coming form the roadway or bridge surgace and trickling the water away thereform.

In the present invention, the sustaining pedestal, the stepped bench unit, and the foundation are engaged with screws at proper positions.

In the present invention, the contact edge of the respective expansion shim can be made into an arcuate shape or the like according to actual requirement.

In case it is considered necessary, the sustaining members can be reinforced with several reinforcement ribs.

As for the construction, a specially designed clearance gage is utilized for precisely determining clearance between two foundation members of expansion joint. The clearance gage is a supporting saddle with two parallelly erected plates at both sides. The construction steps are: Setting the clearance gage on the slide surfaces of the foundation to check the precise distance between the two foundation members, and then removing the clearance gage. Setting the bottom of the stepped bench unit on the slide surfaces. Setting the sustaining pedestal on the stepped bench unit. Connecting the expansion shim assemblies and the sustaining pedestal with both hinge pins and adjusting mutual positional relation. Engaging the sustaining pedestal, the stepped bench unit, and the foundation with tightening screws. Installing the water receptacle.

BRIEF DESCRIPTION OF THE DRAWINGS

To enable a further understanding of the innovative and technological content of the invention herein, refer to the detailed description of the invention and the accompanying brief description of the drawings appended below.

DETAILED DESCRIPTION OF THE PREFERRED EMBODIMENT

Figure 1:
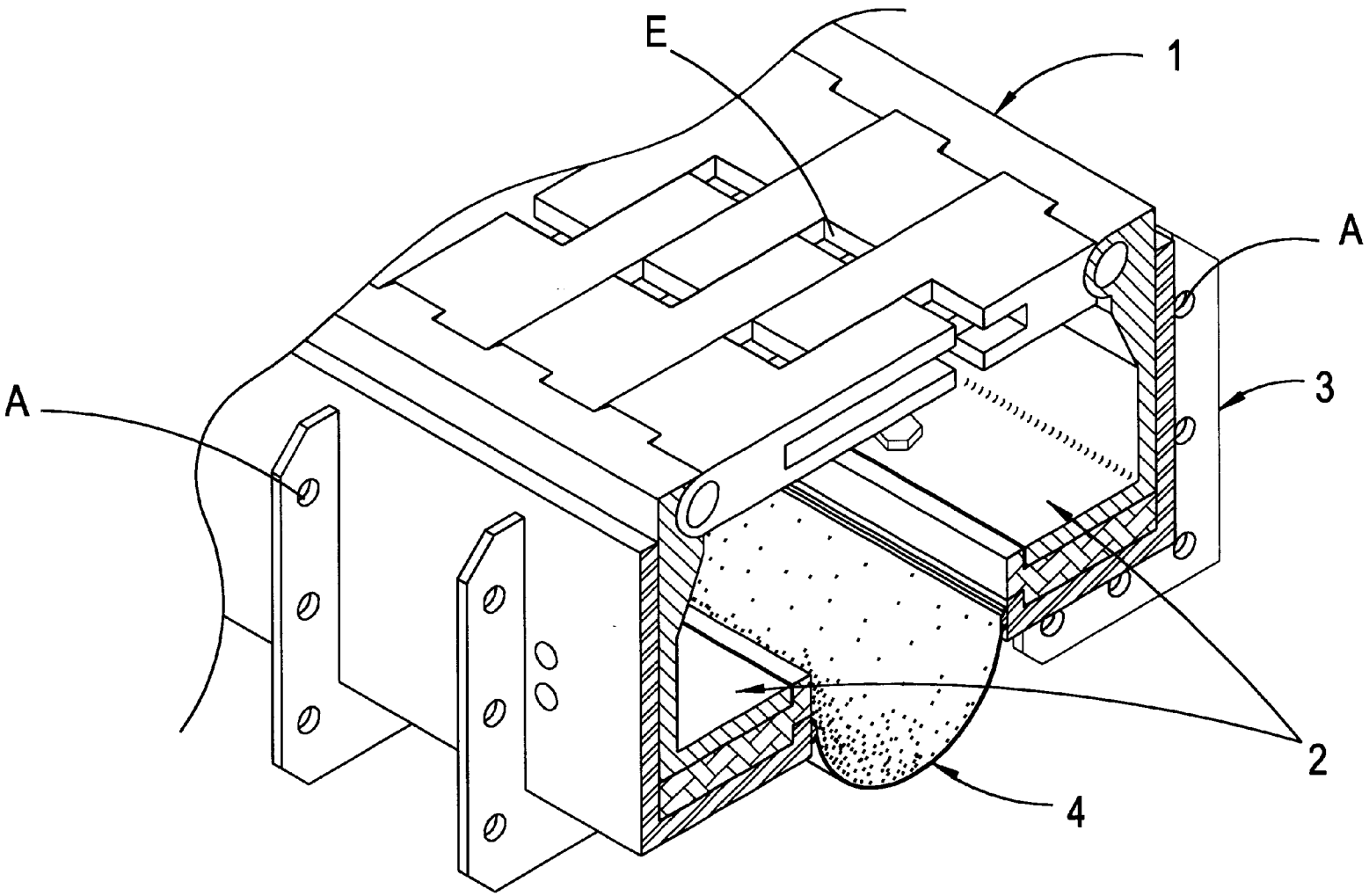
FIG. 1 is a three dimensional assembly view of the expansion joint of the present invention.
Figure 2:
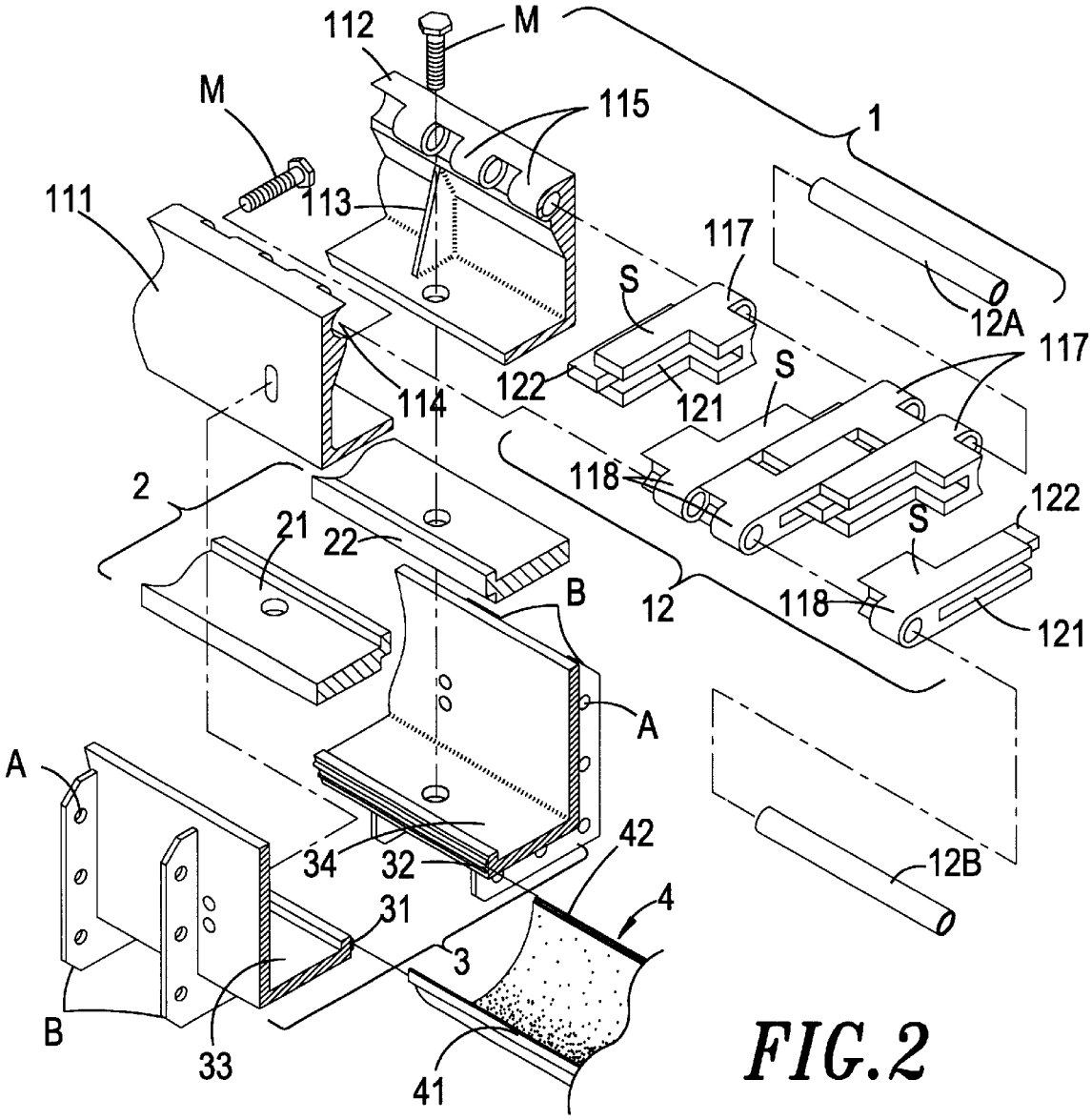
FIG. 2 is an exploded view of the expansion joint of the present invention.

For understanding the structure of the present invention, reference should be made to FIGS. 1 and 2, which respectively show a three dimensional assembly view and an exploded view of the expansion joint according to the present invention. The expansion joint comprises a sustaining pedestal 1 which is further formed of two sustaining L shaped members 111 and 112. The top edge of each sustaining member 111 or 112 is formed into a hinge bracket 114 or 115 with a hinge hole. Several expansion shim assemblies 12, each containing a bifurcated tooth-like shim 121 hinged to both side sustaining members 111 and 112, are indented respectively with those arrayed at opposite positions. Each expansion shim assembly 12 includes an independent tongue piece 122 hinged to the sustaining member 111 or 112 and is interposed in a gap 121 of the bifurcated expansion shim S and indented each other with a respective opposing member. The contact edges of the respective expansion shims S can be made into an arcuate shape or the like according to actual requirement. A hinge pin 12A or 12B is used to connect each hinge bracket 114 or 115 of the sustaining member 111 or 112 with a lug 117 or 118 of the expansion shim assembly 12 such that the expansion shim assemblies 12 are pivotally connected to the sustaining members 111 and 112.

Figure 2A:
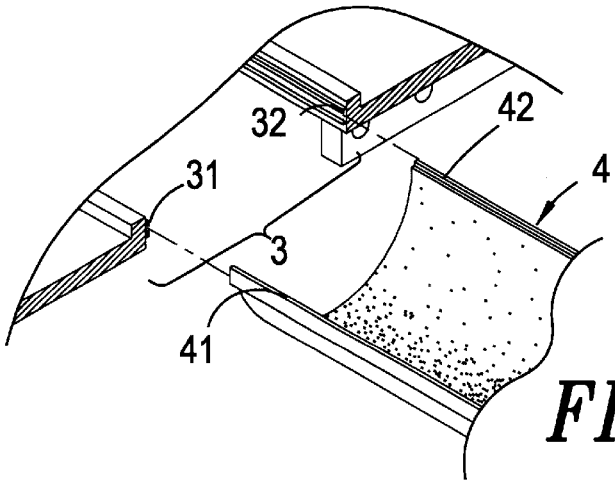
FIG. 2A is a constructional view of the water receptacle of the present invention.

The sustaining members 111 and 112 can be reinforced with several reinforcement ribs 113 in case it is considered necessary. A foundation 3, formed of two L shaped side members having a slide surface 33 or 34 at each bottom surface thereof, is provided with several fins B, having several holes A formed therethrough, the fins B being formed on side surfaces of the respective L-shaped side members. Additionally, a guide rail 31 or 32 is formed along each outer edge of the slide surface 33 or 34. A stepped bench unit 2, formed of a pair of benches disposed at different elevations, is slidably mounted on both slide surfaces 33, 34 of the foundation 3. A water receptacle 4 made of watertight material and having flanges 41 and 42 along both side edges is positioned with the flanges 41 and 42 placed in the guide rails 31 and 32 of the foundation 3, respectively, to collect the water coming from the roadway or bridge surface and directing the flow of water away therefrom (see FIG. 2A). The sustaining pedestal 1, the stepped bench unit 2, and the foundation 3 are engaged with screws M at proper positions thus completing an entire expansion joint assembly.

Figure 3A:
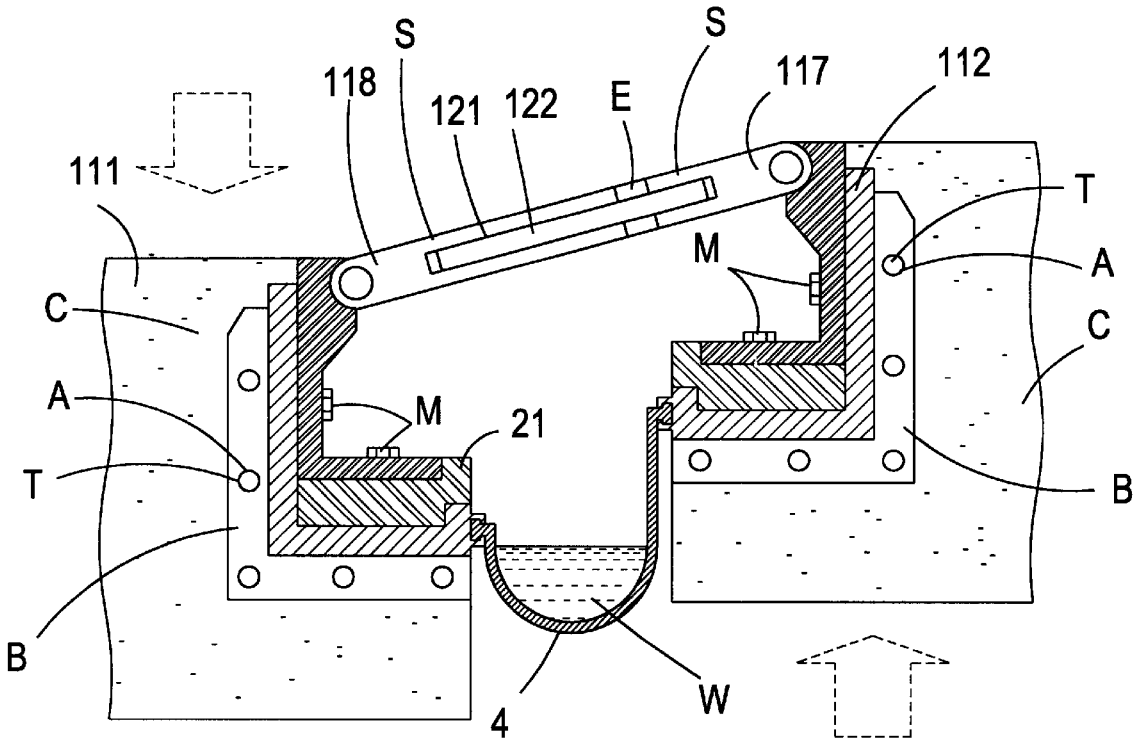
FIG. 3A is an illustrative view showing that roadway or bridge surface is relatively displaced in vertical direction at two sides of the expansion joint.

For understanding the rapid response of the expansion joint of the present invention to deformation of a roadway or bridge in the vertical direction, reference should be made to FIG. 3A. When a roadway or bridge surface C is displaced in the vertical direction, the deformation of the roadway or bridge is maintained within an allowable limit E without collapsing by the cooperating function of the independent tongue pieces 122 in the gaps 121 and the expansion shims S, with the aid of the expansion shim assemblies 12 turning about the hinge pins 12A and 12B. At this time, the water tightness of the water receptacle 4 is free from destruction as it is made of watertight material.

Figure 3B:
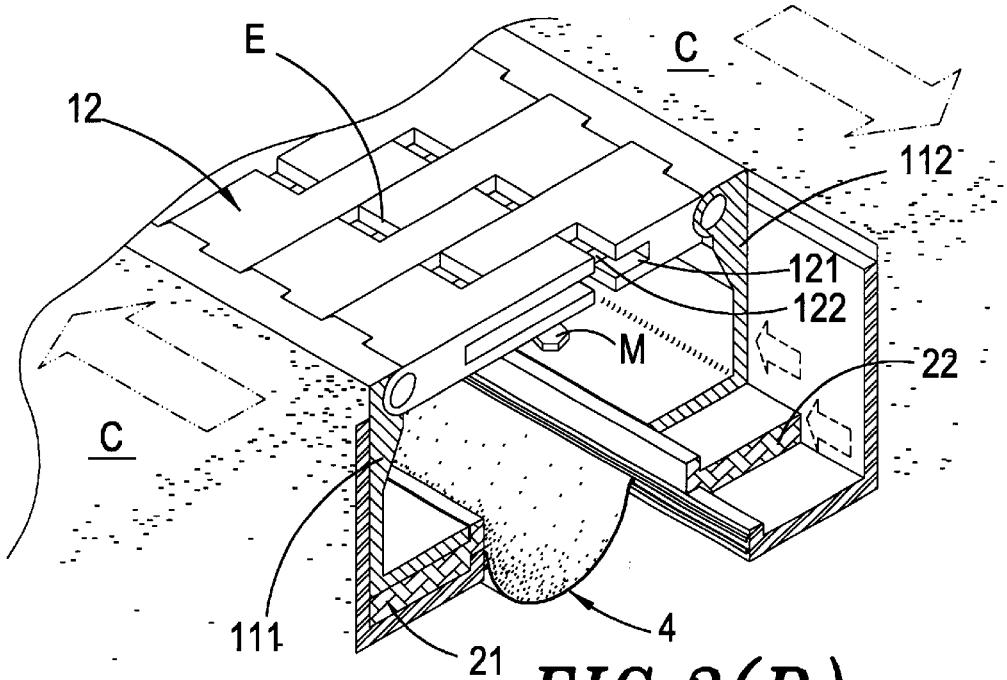
FIG. 3B is an illustrative view showing that roadway or bridge surface is relatively displaced in horizontal direction at two sides of the expansion joint.

For understanding rapid response of the expansion joint of the present invention due to deformation of roadway or bridge in the horizontal direction, reference should be made to FIG. 3B. When a roadway or bridge surface is displaced in the horizontal direction by an external force exceeding the engaging strength of the screws M, the screws M may possibly be broken by a shearing force produced among the sustaining pedestal 1, stepped bench unit 2 and the foundation 3. As a result, sustaining pedestal 1 may slip on the stepped bench unit 2, or the stepped bench unit 2 may slip on the slide surfaces 33 and 34. In this version, it is helpful for readjusting and repairing the roadway or bridge surface C without affecting its strength. Similarly, the water receptacle 4 is able to retain its normal function as it is made of a water tight material.

Figure 4:
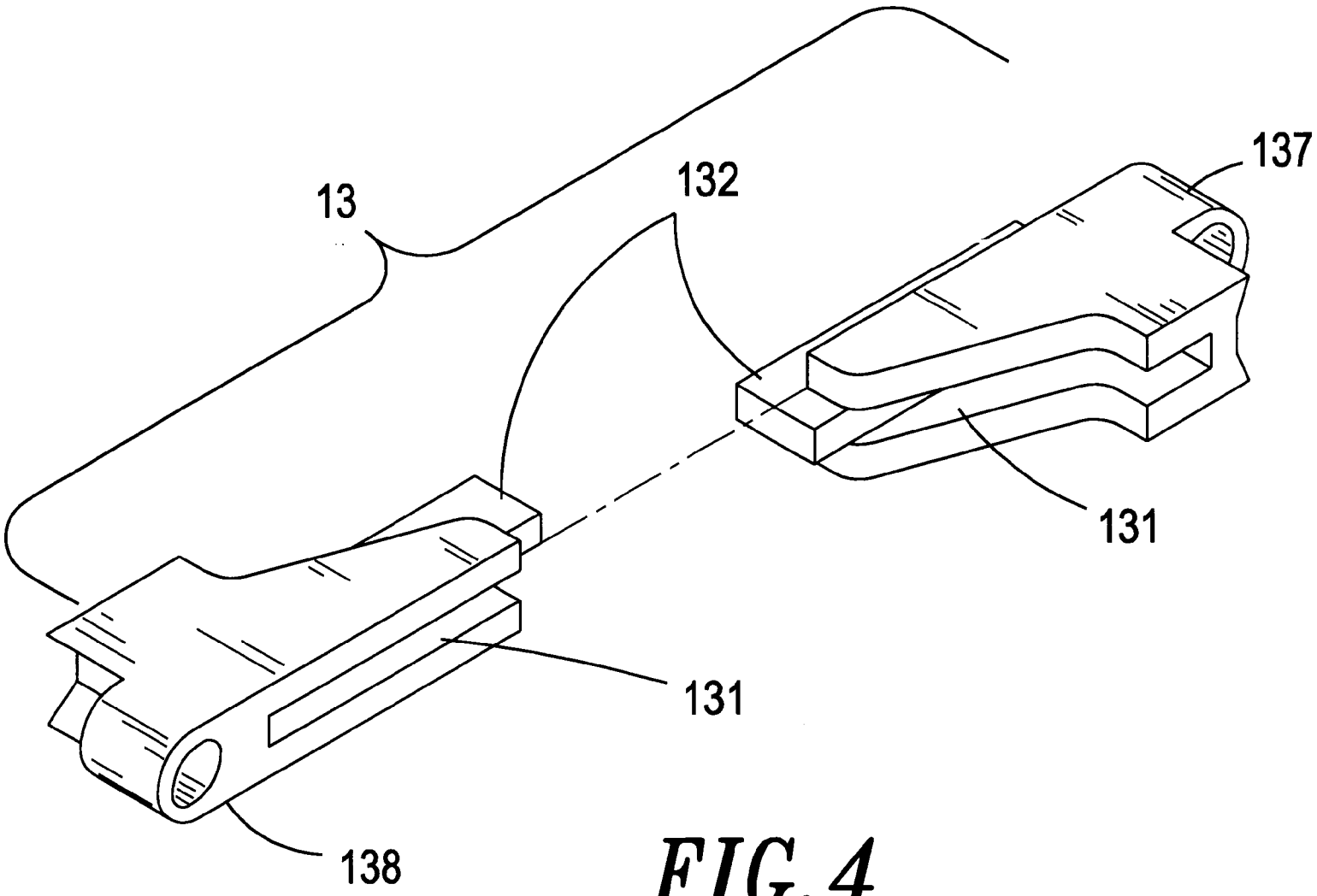
FIG. 4 is an illustrative view showing the structure of an expansion-shim assembly of the present invention.

FIG. 4 is an illustrative view showing the structure of an expansion shim assembly 12 of the present invention. As shown in FIG. 4, the contact edge of the respective expansion shim can be made into an arcuate shape or the like according to actual requirement. An expansion shim 13 contains a gap 131 and a tongue piece 132. The lugs 137 and 138 at each end of the expansion shims 13 are turnably conjoined with hinge pins 12A and 12B.

Figure 5:
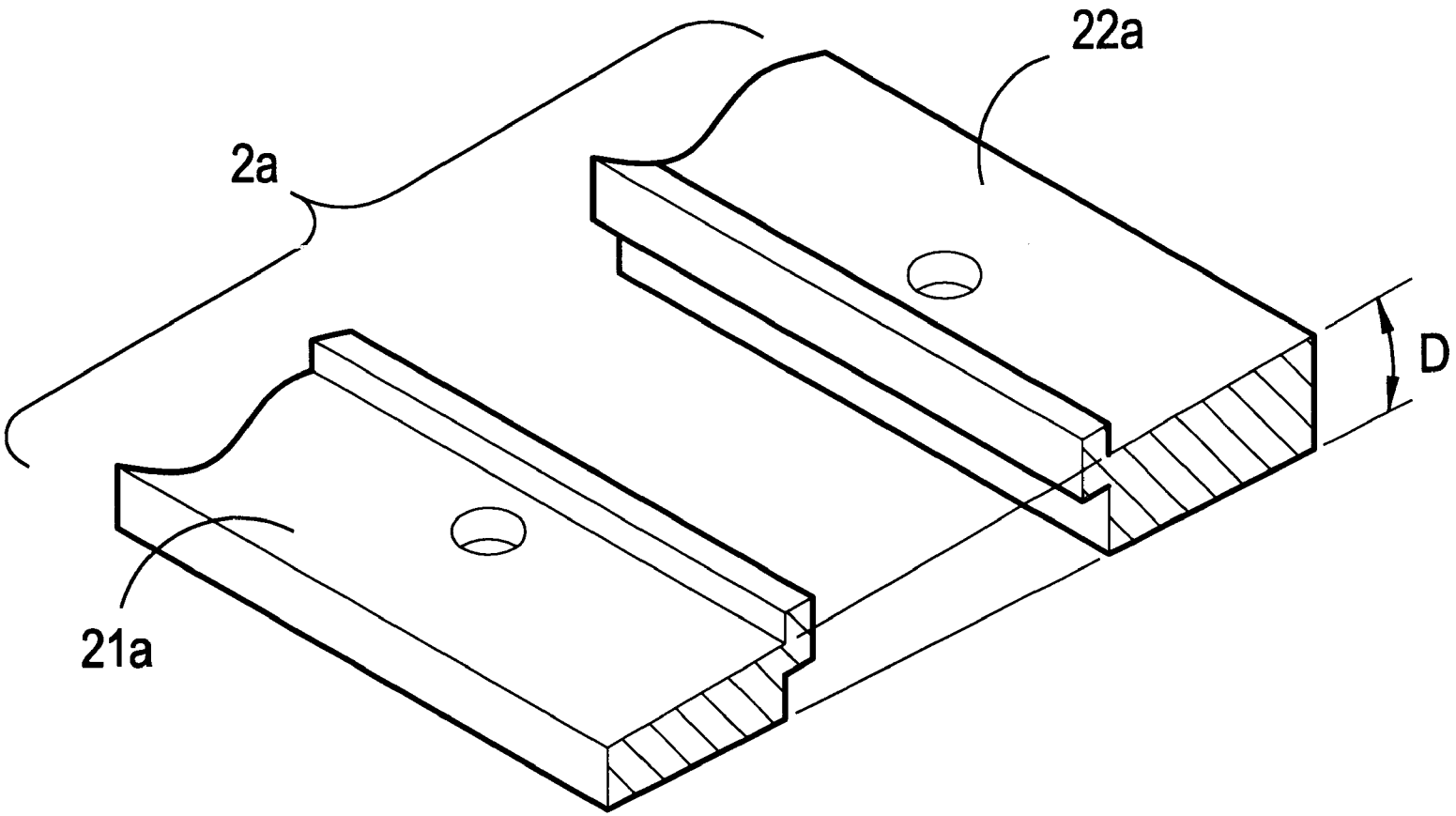
FIG. 5 is an illustrative view of the stepped bench unit of the present invention.

FIG. 5 is an illustrative view showing the stepped bench unit 2*a* of the present invention. The tilted angle D between the benches 21*a* and 22*a* can be determined according to the grade of the roadway or bridge.

Figure 6B:
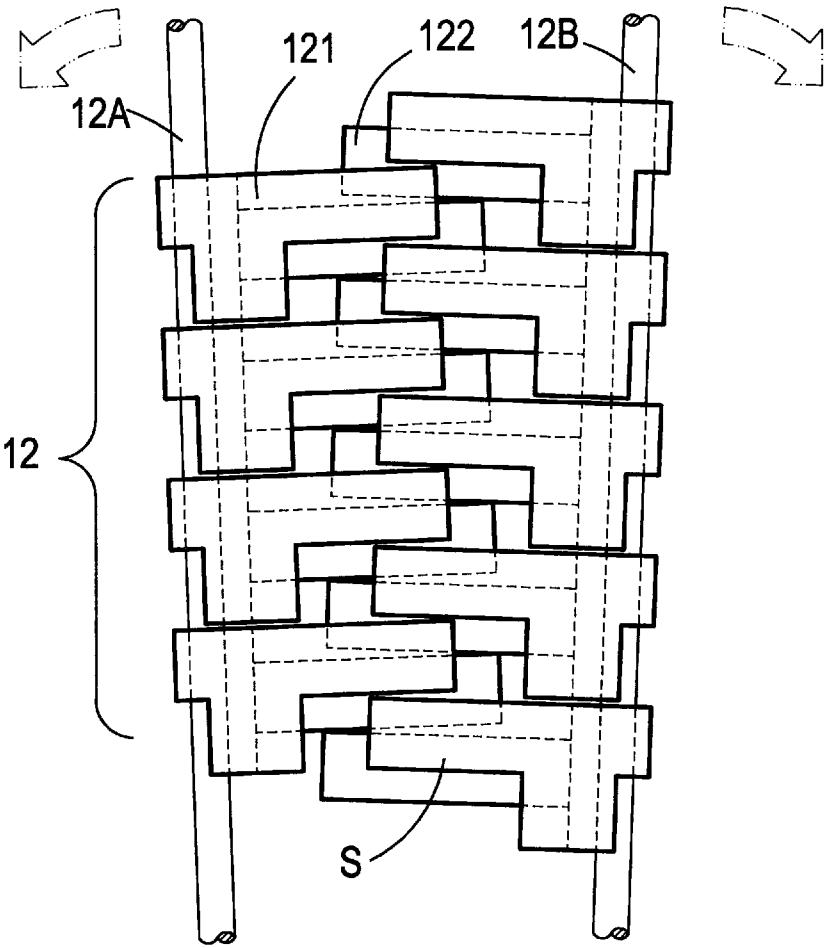
FIG. 6B is a view showing variation in relative position of components of expansion shim assemblies in case a relative displacement of roadway or bridge surface occurs at two sides of the expansion joint.
Figure 6A:
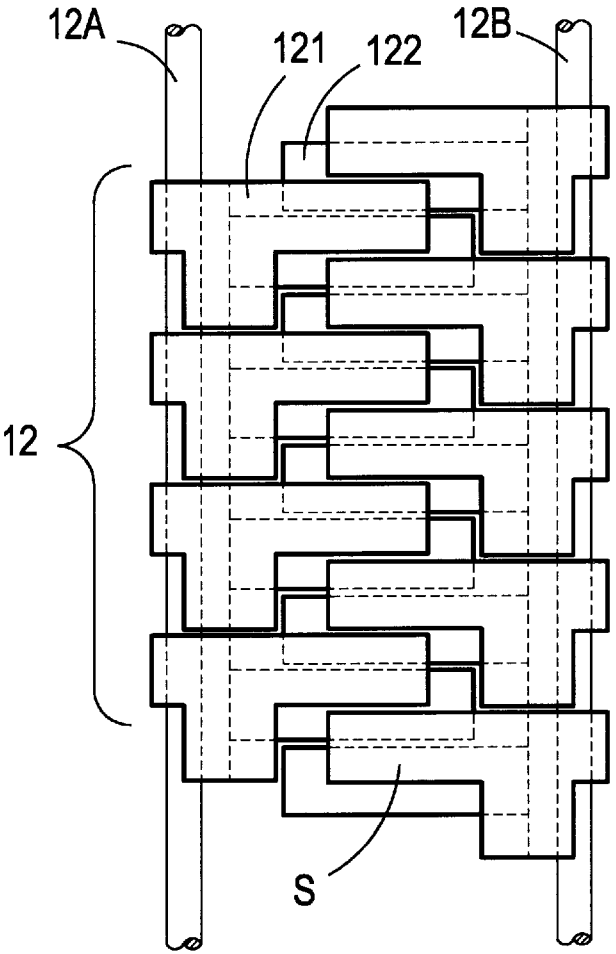
FIG. 6A is a view showing normal state of expansion shim assemblies in the expansion joint of the present invention.

For understanding how the expansion shim assemblies work in case of asymmetrical deformation of the roadway or bridge surface, reference should be made to FIGS. 6A and 6B. As shown in FIG. 6B, variation in the state of expansion of the shim assemblies is clearly observed where the expansion shims S still retain the allowable limit. In this version, the deformed expansion joint is repairable and reusable.

Figure 7:
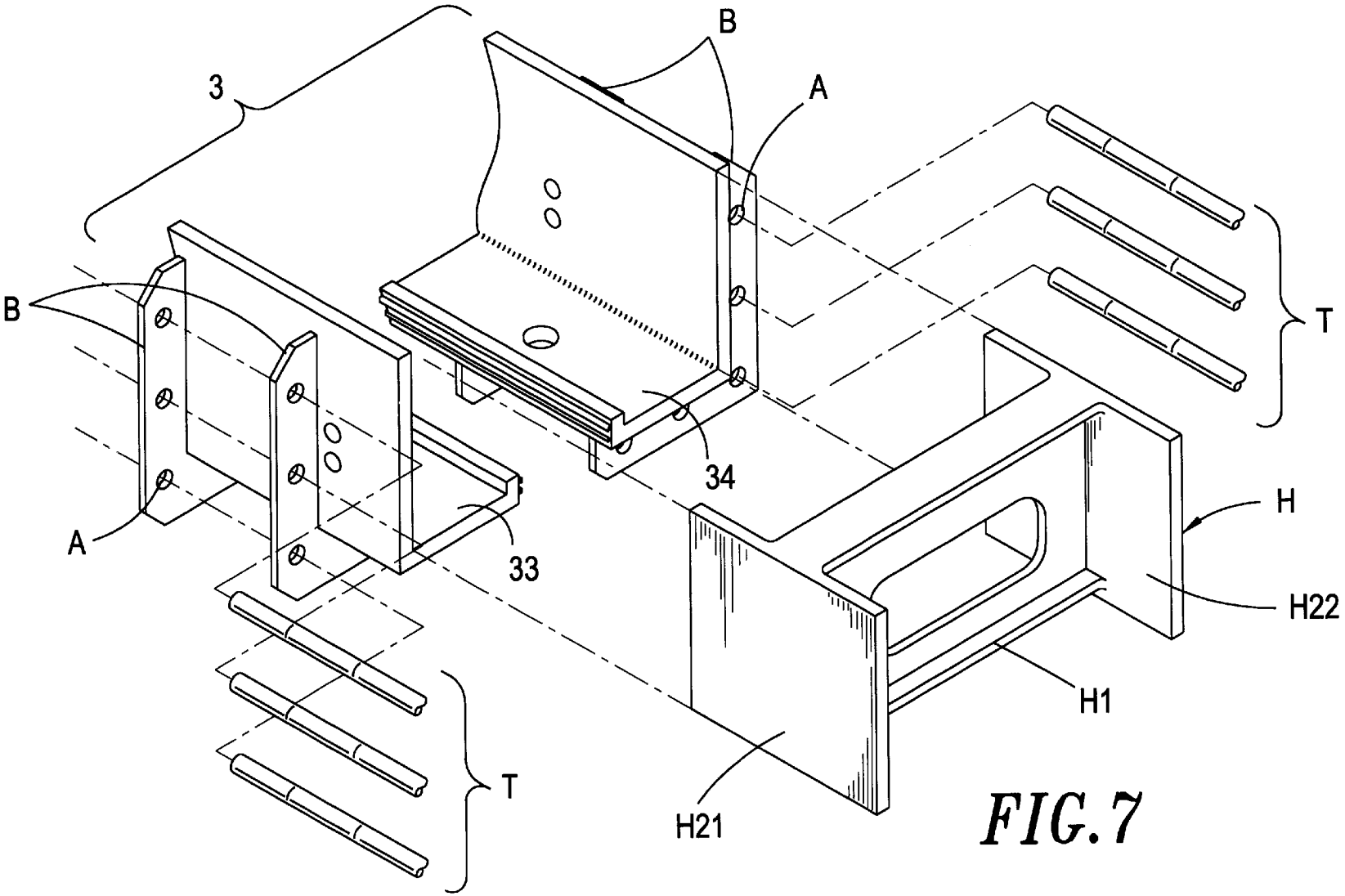
FIG. 7 is a three dimensional view illustrating how the clearance gage is applied in construction of an expansion joint at the site.
Figure 8:
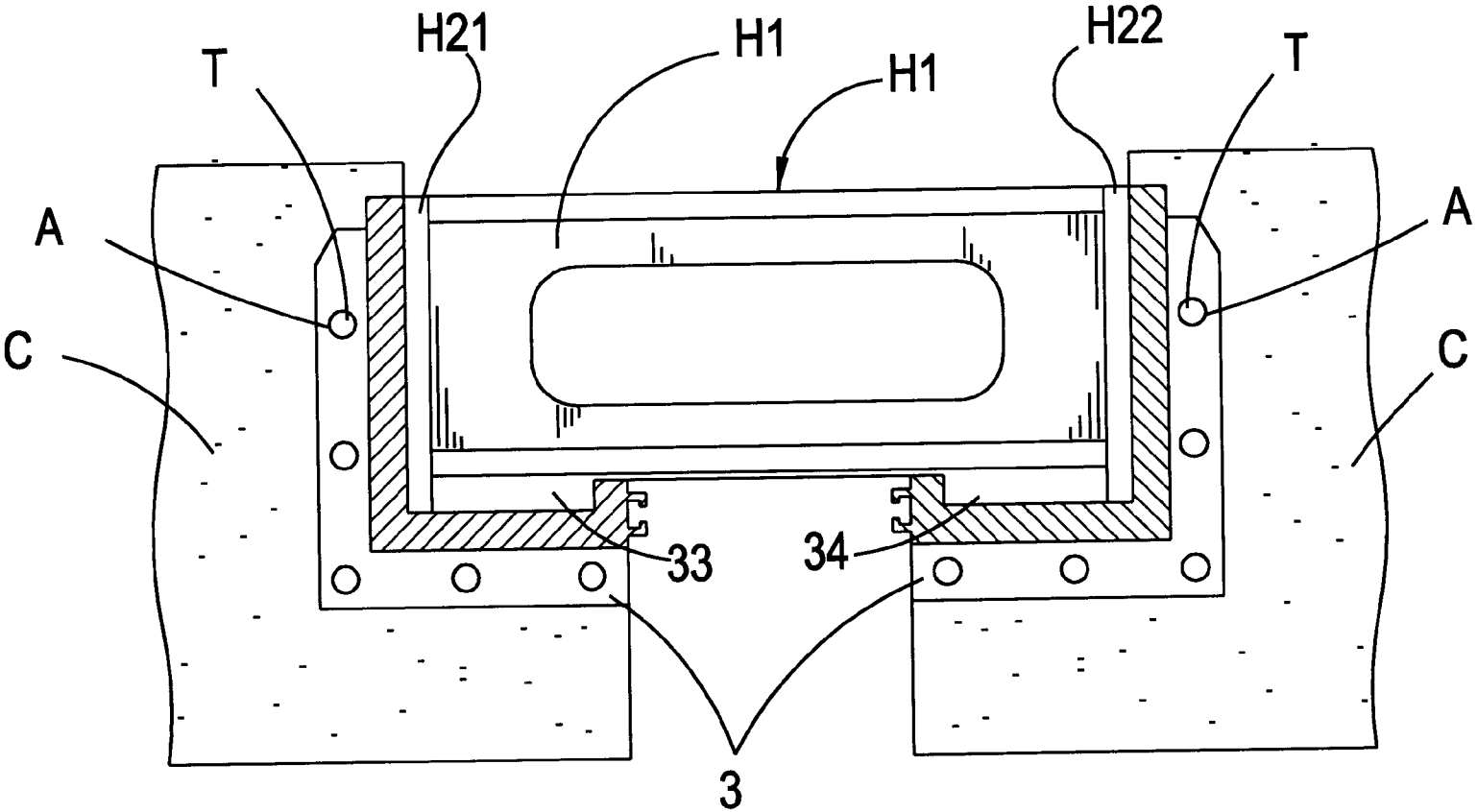
FIG. 8 is a side cross sectional view of FIG. 7.

For understanding how a clearance gage H is used for construction of an expansion joint of the present invention, reference should be made to FIGS. 7 and 8. The clearance gage H is actually a supporting saddle HI with two parallely erected plates H21 and H22 spacing in predetermined distance at both sides. The through holes A on the fins B of the foundation 3 can be strung together before pre-burying the foundation 3 in the roadway or bridge so as to intensify binding force therebetween.

Referring to FIGS. 2, 7 and 8, the construction of the expansion joint comprises the steps of: 1.Setting the clearance gage H on the slide surfaces 33 and 34 of the foundation 3 to check the precise distance between the two foundation members, and removing the clearance gage H. 2.Setting the bottom of the stepped bench unit 2 on the slide surfaces 33 and 34. 3.Setting the sustaining pedestal 1 on the stepped bench unit 2. 4.Connecting the expansion shim assemblies 12 and the sustaining pedestal 1 with hinge pins 12A and 12B and adjusting mutual positional relation. 5.Engaging the sustaining pedestal 1, the stepped bench unit 2, and the foundation 3 with tightening screws M. 6.Installing the water receptacle 4.

It emerges from the description of the above example that the invention has several noteworthy advantages, in particular:

1. The expansion joint of the present invention is simply constructed, easy for installation and maintenance thereby cutting down the necessary cost.

2. It is applicable to horizontal, vertical and asymmetrical deformation of roadways and bridges, especially effective in prolonging bridge lifetime.

3. Using a specially designed clearance gage to determine the related precise dimensions in construction at site results in getting an accurate and effective structure for an expansion joint.

Those who are skilled in the art will readily perceive how to modify the invention. Therefore, the appended claims are to be construed to conver all equivalent structures which fall within the true scope and spirit of the invention.

What is claimed is:

1. A vibration resistant expansion joint comprising:

a sustaining pedestal having a pair of sustaining L-shaped members, a top edge of each L-shaped member having a hinge bracket formed thereon, said hinge bracket having a hinge hole formed therethrough;

a plurality of expansion shim assemblies each having a bifurcated shim pivotally secured to said sustaining L-shaped members, each said bifurcated shim being in interlocking relation with adjacent shims, each said bifurcated shim having a tongue member projecting therefrom, said tongue member being received in a slot formed in said adjacent bifurcated shim;

a pair of hinge pins for connecting each said sustaining L-shaped member with each said expansion shim assembly;

a foundation having a pair of L-shaped side members, each of said L-shaped side members having a slide surface formed on a bottom edge thereof, each of said L-shaped side members being provided with a plurality of fins formed on a side surface thereof, each said fin having a plurality of holes formed therethrough, a guide rail being formed on an outer edge of each of said slide surfaces;

a stepped bench unit formed of a pair of benches, each of said benches being slidably mounted on a respective slide surface of said foundation; and, a water receptacle having flanges formed on opposing side edges thereof and being mounted on said guide rails of said foundation to collect water coming from a roadway or bridge surface and directing flow of said water away therefrom.

2. The vibration resistant expansion joint of claim 1, wherein said sustaining pedestal, said stepped bench unit, and said foundation are threaded secured, each to the other.

3. The vibration resistant expansion joint of claim 1, wherein a contact edge of said bifurcated shim has a substantially arcuate contour.

4. The vibration resistant expansion joint of claim 1, wherein said water receptacle is made of a watertight material.

5. The vibration resistant expansion joint of claim 1, wherein said sustaining pedestal is reinforced with a plurality of reinforcement ribs.

6. The vibration resistant expansion joint of claim 1, wherein said stepped bench unit is angled in accordance with a grade of said roadway or bridge.

7. A method of forming vibration resistant expansion joints comprising the steps:

(1) setting a clearance gauge on slide surfaces of a foundation in order to determine a distance between a pair of foundation members forming said foundation, and then removing said clearance gauge;

(2) positioning a bottom surface of a stepped bench unit on said slide surfaces;

(3) positioning a sustaining pedestal on said stepped bench unit;

(4) connecting a plurality of expansion shim assemblies to said sustaining pedestal with a pair of hinge pins and adjusting mutual positional relation therebetween;

(5) engaging said sustaining pedestal, said stepped bench unit, and said foundations with a plurality of tightening screws; and, (6) installing a water receptacle on said foundation.

8. The method of forming vibration resistant expansion joints of claim 7, wherein said clearance gauge is a supporting saddle with two parallel plates spaced apart from each other a predetermined distance.

9. The method of forming vibration resistant expansion joints of claim 7 wherein said foundation is buried at the site of construction prior to construction.

* * * * *